US011374335B2

(12) United States Patent
Tsai

(10) Patent No.: US 11,374,335 B2
(45) Date of Patent: Jun. 28, 2022

(54) ANTENNA SYSTEM

(71) Applicant: Quanta Computer Inc., Taoyuan (TW)

(72) Inventor: Ming-Che Tsai, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 80 days.

(21) Appl. No.: 17/093,742

(22) Filed: Nov. 10, 2020

(65) Prior Publication Data

US 2022/0109250 A1 Apr. 7, 2022

(30) Foreign Application Priority Data

Oct. 5, 2020 (TW) ..... 109134329

(51) Int. Cl.
*H01Q 21/28* (2006.01)
*H01Q 5/35* (2015.01)

(52) U.S. Cl.
CPC ..... *H01Q 21/28* (2013.01); *H01Q 5/35* (2015.01)

(58) Field of Classification Search
CPC ..... H01Q 21/28; H01Q 5/35; H01Q 5/364; H01Q 1/38; H01Q 1/243; H01Q 5/25; H01Q 5/371; H01Q 5/385
See application file for complete search history.

(56) References Cited

U.S. PATENT DOCUMENTS 6,259,407 B1 * 7/2001 Tran ..... H01Q 1/243 343/702
10,069,196 B1 * 9/2018 Yen ..... H01Q 1/243
2004/0125030 A1 7/2004 Sung et al.
2011/0215971 A1 * 9/2011 Rao ..... H01Q 21/28 343/893
2013/0088404 A1 * 4/2013 Ramachandran ..... H01Q 1/243 343/861
2014/0198012 A1 * 7/2014 Tseng ..... H01Q 21/28 343/876
2020/0006850 A1 * 1/2020 Filatov ..... H01Q 21/28

OTHER PUBLICATIONS

Chinese language office action dated Jun. 7, 2021, issued in application No. TW 109134329.

* cited by examiner

*Primary Examiner* — Dimary S Lopez Cruz
*Assistant Examiner* — Michael M Bouizza
(74) *Attorney, Agent, or Firm* — McClure, Qualey & Rodack, LLP

(57) ABSTRACT

An antenna system includes a ground plane, a first nonconductive support element, a first antenna element, a second nonconductive support element, and a second antenna element. The first nonconductive support element is adjacent to the ground plane. The first antenna element is distributed over the first nonconductive support element. The first antenna element is excited by a first signal source. The second nonconductive support element is adjacent to the ground plane. The second antenna element is distributed over the second nonconductive support element. The second antenna element is excited by a second signal source. Both the first antenna element and the second antenna element can cover a wide operation frequency band of LTE/5G.

9 Claims, 6 Drawing Sheets

ANTENNA SYSTEM

CROSS REFERENCE TO RELATED APPLICATIONS

This application claims priority of Taiwan Patent Application No. 109134329 filed on Oct. 5, 2020 the entirety of which is incorporated by reference herein.

BACKGROUND OF THE INVENTION

Field of the Invention

The disclosure generally relates to an antenna system, and more particularly, it relates to an antenna system supporting wideband operations.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna system.

BRIEF SUMMARY OF THE INVENTION

In an exemplary embodiment, the disclosure is directed to an antenna system that includes a ground plane, a first nonconductive support element, a first antenna element, a second nonconductive support element, and a second antenna element. The first nonconductive support element is adjacent to the ground plane. The first antenna element is distributed over the first nonconductive support element. The first antenna element is excited by a first signal source. The second nonconductive support element is adjacent to the ground plane. The second antenna element is distributed over the second nonconductive support element. The second antenna element is excited by a second signal source. Both the first antenna element and the second antenna element can cover a wide operation frequency band of LTE/5G.

In some embodiments, the wide operation frequency band includes a first frequency interval, a second frequency interval, a third frequency interval, and a fourth frequency interval. The first frequency interval is from 700 MHz to 960 MHz. The second frequency interval is from 1710 MHz to 2170 MHz. The third frequency interval is from 2300 MHz to 2690 MHz. The fourth frequency interval is from 3300 MHz to 5000 MHz.

In some embodiments, the first antenna element includes a first feeding element, a first radiation element, a second radiation element, and a third radiation element. The first feeding element is coupled to the first signal source. The first radiation element is coupled to the first feeding element. The first radiation element has a notch region. The second radiation element is coupled to the ground plane, and is disposed adjacent to the first radiation element. The third radiation element is coupled to the ground plane, and is disposed adjacent to the first radiation element. The first feeding element is positioned between the second radiation element and the third radiation element.

In some embodiments, the first radiation element has a shape that is substantially rectangular, and the notch region has a shape that is substantially square.

In some embodiments, the second radiation element has a shape that is substantially a long, straight line, and the third radiation element has a shape that is substantially a short, straight line.

In some embodiments, the length of the first radiation element is shorter than or equal to 0.5 wavelength of the first frequency interval. The length of the second radiation element is from 0.25 to 0.5 wavelength of the third frequency interval. The length of the third radiation element is from 0.25 to 0.5 wavelength of the fourth frequency interval.

In some embodiments, the second antenna element includes a second feeding element, a fourth radiation element, a fifth radiation element, and a sixth radiation element. The second feeding element is coupled to the second signal source. The fourth radiation element is coupled to the second feeding element. The fourth radiation element includes a terminal bifurcation structure. The fifth radiation element is coupled to the ground plane, and is disposed adjacent to the fourth radiation element. The sixth radiation element is coupled to the ground plane. The second feeding element is positioned between the fifth radiation element and the sixth radiation element.

In some embodiments, the terminal bifurcation structure of the fourth radiation element includes a first rectangular widening portion and a second rectangular widening portion. A monopole slot is formed between the first rectangular widening portion and the second rectangular widening portion.

In some embodiments, the fifth radiation element is substantially N-shaped, and the sixth radiation element is substantially inverted J-shaped.

In some embodiments, the total length of the second feeding element and the fourth radiation element is shorter than or equal to 0.5 wavelength of the first frequency interval. The length of the fifth radiation element is from 0.25 to 0.5 wavelength of the third frequency interval. The length of the sixth radiation element is from 0.25 to 0.5 wavelength of the fourth frequency interval.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
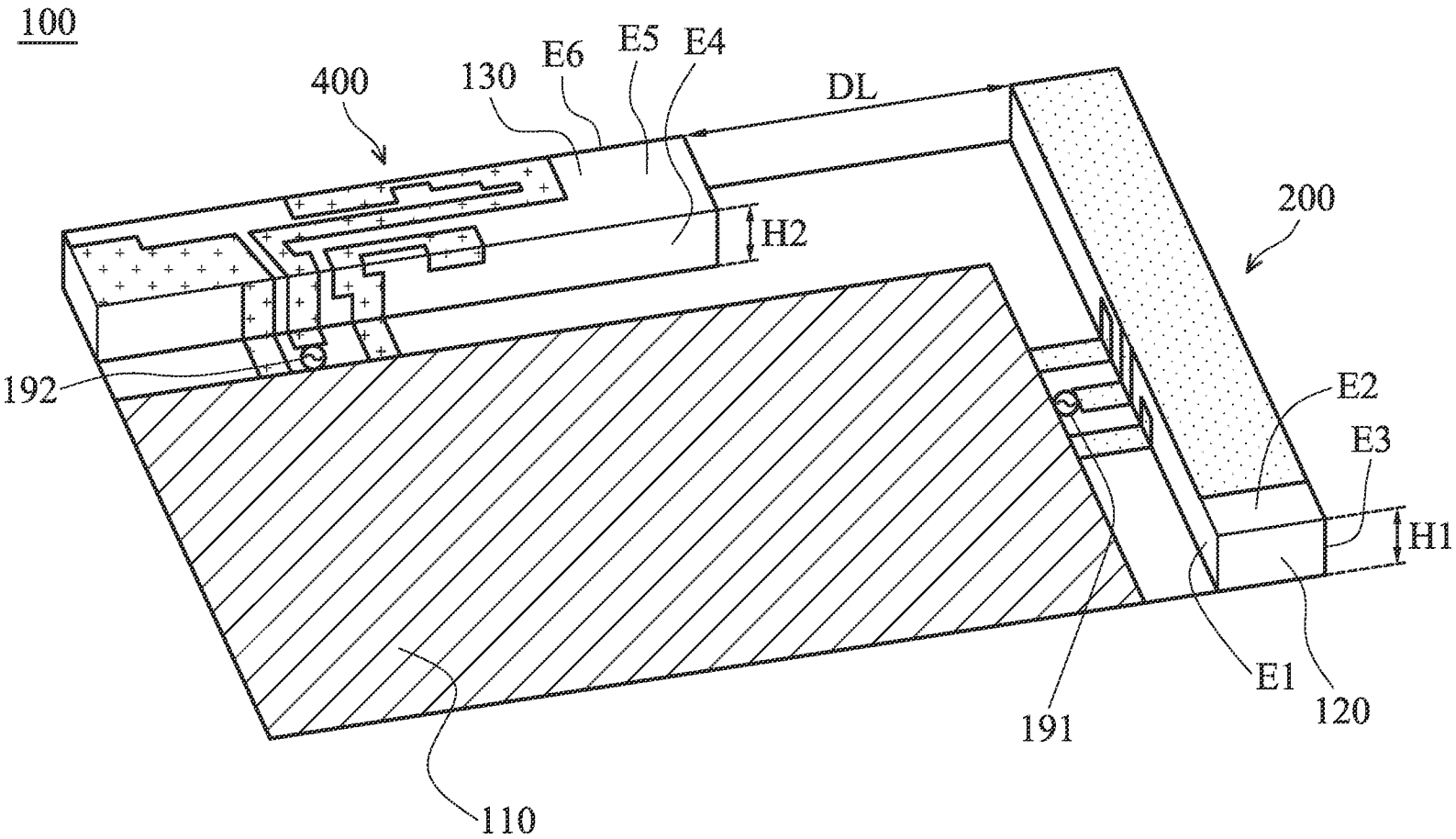
FIG. 1 is a perspective view of an antenna system according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a perspective view of an antenna system 100 according to an embodiment of the invention. The antenna system 100 may be applied to a communication device or an automotive electronic device, but it is not limited thereto. As shown in FIG. 1, the antenna system 100 includes a ground plane 110, a first nonconductive support element 120, a second nonconductive support element 130, a first antenna element 200, and a second antenna element 400. The ground plane 110, the first antenna element 200, and the second antenna element 400 may all be made of metal materials, such as silver, copper, aluminum, iron, or their alloys.

The shapes and types of the first antenna element 200 and the second antenna element 400 are not limited in the invention. For example, any of the first antenna element 200 and the second antenna element 400 may be a monopole antenna, a dipole antenna, a patch antenna, a coupled-fed antenna, a PIFA (Planar Inverted F Antenna), a chip antenna, or a hybrid antenna. In a preferred embodiment, both the first antenna element 200 and the second antenna element 400 can cover a wide operation frequency band of LTE (Long Term Evolution)/5G ($5^{th}$ Generation Wireless Systems).

The ground plane 110 may substantially have a rectangular plane for providing a ground voltage VSS. The first nonconductive support element 120 is adjacent to the ground plane 110. The first nonconductive support element 120 has a first surface E1, a second surface E2, and a third surface E3. The first surface E1 is substantially parallel to the third surface E3. The second surface E2 is substantially perpendicular to the first surface E1 and the third surface E3. The first antenna element 200 is distributed over the first surface E1, the second surface E2, and the third surface E3 of the first nonconductive support element 120. The first antenna element 200 is excited by a first signal source 191. The second nonconductive support element 130 is adjacent to the ground plane 110. The second nonconductive support element 130 has a fourth surface E4, a fifth surface E5, and a sixth surface E6. The fourth surface E4 is substantially parallel to the sixth surface E6. The fifth surface E5 is substantially perpendicular to the fourth surface E4 and the sixth surface E6. The second antenna element 400 is distributed over the fourth surface E4, the fifth surface E5, and the sixth surface E6 of the second nonconductive support element 130. The second antenna element 400 is excited by a second signal source 192. Each of the first signal source 191 and the second signal source 192 may be an RF (Radio Frequency) module. It should be noted that the term "adjacent" or "close" over the disclosure means that the distance (spacing) between two corresponding elements is smaller than a predetermined distance (e.g., 5 mm or shorter), but often does not mean that the two corresponding elements are touching each other directly (i.e., the aforementioned distance/spacing therebetween is reduced to 0). According to practical measurements, the antenna system 100 provides multiple polarization directions and good isolation between antennas since the first antenna element 200 and the second antenna element 400 are arranged to be substantially perpendicular to each other.

The following embodiments will introduce the detail structural features of the first antenna element 200 and the second antenna element 400. It should be understood that these figures and descriptions are merely exemplary, rather than limitations of the invention.

Figure 2:
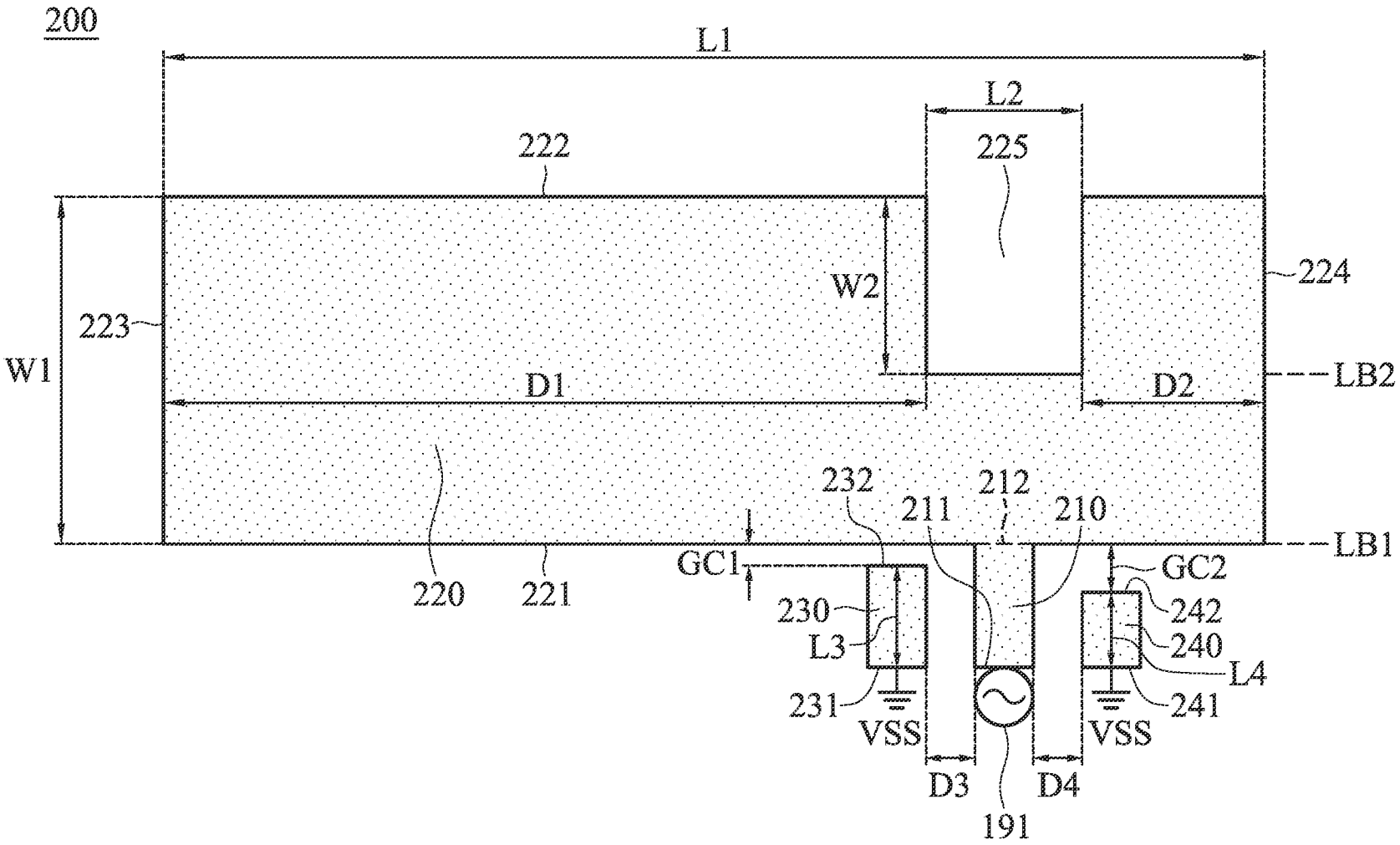
FIG. 2 is a developed view of a first antenna element according to an embodiment of the invention.

FIG. 2 is a developed view of the first antenna element 200 according to an embodiment of the invention. Please refer to FIG. 1 and FIG. 2 together. The first antenna element 200 can be bent by 90 degrees with respect to a first bending line LB1 and a second bending line LB2. The first bending line LB1 may be positioned between the first surface E1 and the second surface E2 of the first nonconductive support element 120. The second bending line LB2 may be positioned between the second surface E2 and the third surface E3 of the first nonconductive support element 120. In the embodiment of FIG. 2, the first antenna element 200 includes a first feeding element 210, a first radiation element 220, a second radiation element 230, and a third radiation element 240.

The first feeding element 210 is positioned between the second radiation element 230 and the third radiation element 240, and is completely separate from the second radiation element 230 and the third radiation element 240. The first feeding element 210 has a first end 211 and a second end 212. The first end 211 of the first feeding element 210 is coupled to the first signal source 191. The first radiation element 220 may substantially have a rectangular shape. The first radiation element 220 has a first edge 221, a second edge 222, a third edge 223, and a fourth edge 224. The first edge 221 and the second edge 222 are opposite and parallel to each other, and they are considered as long sides of the first radiation element 220. The third edge 223 and the fourth edge 224 are opposite and parallel to each other, and they are considered as short sides of the first radiation element 220. The first edge 221 of the first radiation element 220 is further coupled to the second end 212 of the first feeding element 210. In addition, a notch region 225 is formed on the second edge 222 of the first radiation element 220, and the notch region 225 may substantially have a square shape. In some embodiments, the first radiation element 220 extends from the second surface E2 onto the third surface E3 of the first nonconductive support element 120. The notch region 225 is almost completely positioned on the third surface E3 of the first nonconductive support element 120.

The second radiation element 230 may substantially have a long straight-line shape. The second radiation element 230 has a first end 231 and a second end 232. The first end 231 of the second radiation element 230 is coupled to the ground voltage VSS. The second end 232 of the second radiation element 230 is an open end, which is adjacent to the first radiation element 220. A first coupling gap GC1 is formed between the first edge 221 of the first radiation element 220 and the second end 232 of the second radiation element 230. The third radiation element 240 may substantially have a short straight-line shape. The third radiation element 240 has a first end 241 and a second end 242. The first end 241 of the third radiation element 240 is coupled to the ground voltage VSS. The second end 242 of the third radiation element 240 is an open end, which is adjacent to the first radiation element 220. A second coupling gap GC2 is formed between the first edge 221 of the first radiation element 220 and the second end 242 of the third radiation element 240. In some embodiments, the first feeding element 210, the second radiation element 230, and the third radiation element 240 are almost completely positioned on the first surface E1 of the first nonconductive support element 120. In alternative embodiments, the first end 231 of the second radiation element 230 is further coupled through a first matching circuit to the ground voltage VSS, and the first end 241 of the third radiation element 240 is further coupled through a second matching circuit to the ground voltage VSS (not shown). For example, any of the first matching circuit and the second matching circuit may include a capacitor and an inductor which are coupled in parallel, but it is not limited thereto.

Figure 3:
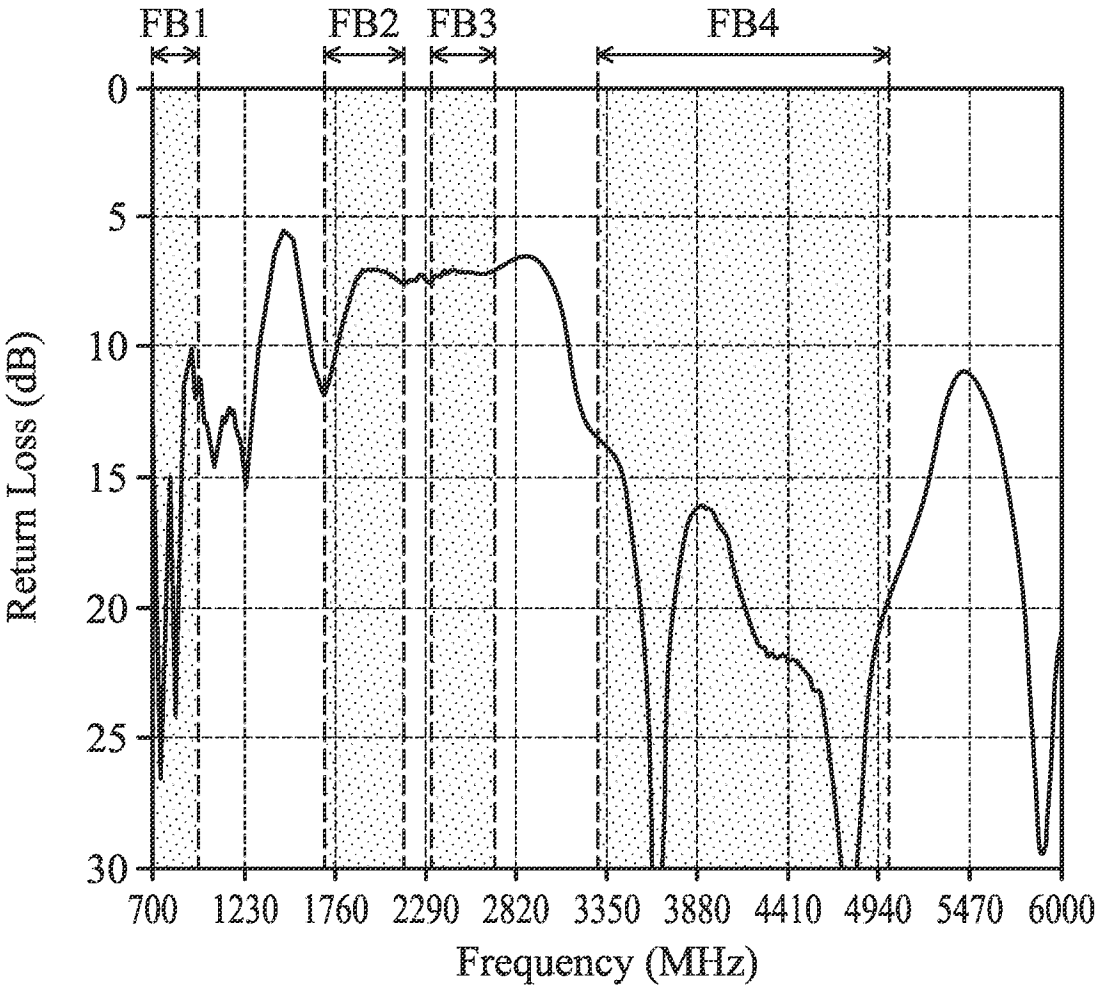
FIG. 3 is a diagram of return loss of a first antenna element according to an embodiment of the invention.

FIG. 3 is a diagram of return loss of the first antenna element 200 according to an embodiment of the invention. The horizontal axis represents the operation frequency (MHz), and the vertical axis represents the return loss (dB). According to the measurement of FIG. 3, the first antenna element 200 can cover a first frequency interval FB1, a second frequency interval FB2, a third frequency interval FB3, and a fourth frequency interval FB4. For example, the first frequency interval FB1 may be from 700 MHz to 960 MHz, the second frequency interval FB2 may be from 1710 MHz to 2170 MHz, the third frequency interval FB3 may be from 2300 MHz to 2690 MHz, and the fourth frequency interval FB4 may be from 3300 MHz to 5000 MHz. Accordingly, the first antenna element 200 can support at least the wideband operations of LTE and 5G.

As to the antenna theory, the first feeding element 210 and the first radiation element 220 are excited to generate the first frequency interval FB1 and the second frequency interval FB2. The second radiation element 230 is excited by the first feeding element 210 and the first radiation element 220 using a coupling mechanism, so as to generate the third frequency interval FB3. The third radiation element 240 is excited by the first feeding element 210 and the first radiation element 220 using a coupling mechanism, so as to generate the fourth frequency interval FB4.

In some embodiments, the element sizes of the first antenna element 200 are described as follows. The length L1 of the first radiation element 220 may be shorter than or equal to 0.5 wavelength (λ/2) of the first frequency interval FB1. The width W1 of the first radiation element 220 may be from 20 mm to 30 mm. The length L2 of the notch region 225 may be from 8 mm to 12 mm. The width W2 of the notch region 225 may be from 8 mm to 12 mm. The length L3 of the second radiation element 230 may be from 0.25 to 0.5 wavelength (λ/4~λ/2) of the third frequency interval FB3. The length L4 of the third radiation element 240 may be from 0.25 to 0.5 wavelength (λ/4~λ/2) of the fourth frequency interval FB4. A first distance D1 is defined between the notch region 225 and the third edge 223 of the first radiation element 220. A second distance D2 is defined between the notch region 225 and the fourth edge 224 of the first radiation element 220. The ratio (D2/D1) of the second distance D2 to the first distance D1 may be from ⅕ to ½, such as about ⅓. The distance D3 between the second radiation element 230 and the first feeding element 210 may be from 1 mm to 2 mm. The distance D4 between the third radiation element 240 and the first feeding element 210 may be from 2 mm to 3 mm. The width of the first coupling gap GC1 may be from 1 mm to 3 mm. The width of the second coupling gap GC2 may be from 2 mm to 4 mm. The height H1 of the first nonconductive support element 120 may be from 7 mm to 11 mm. The above ranges of element sizes are calculated and obtained according to many experiment results, and they help to optimize the operation bandwidth and impedance matching of the first antenna element 200.

Figure 4:
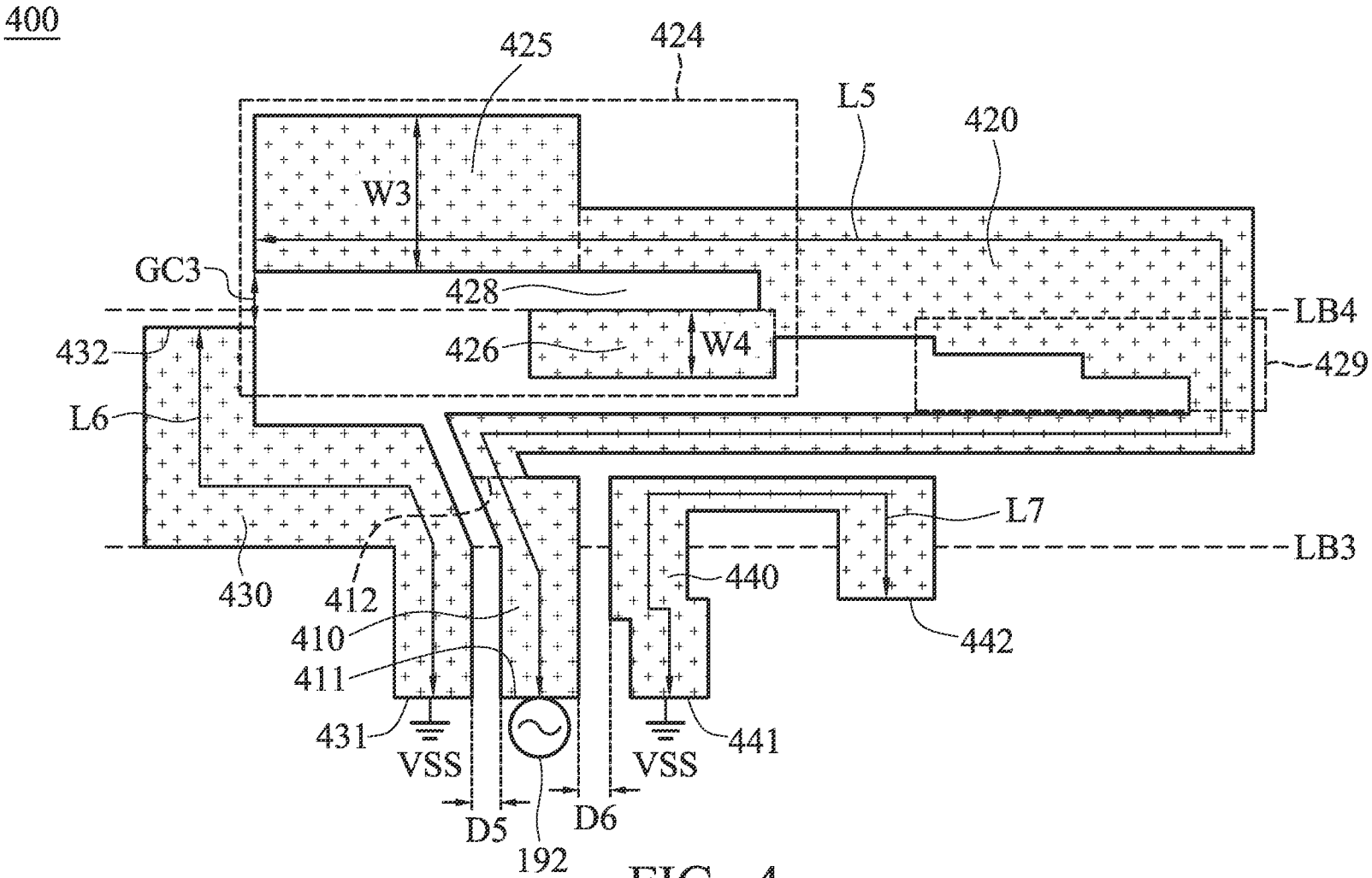
FIG. 4 is a developed view of a second antenna element according to an embodiment of the invention.

FIG. 4 is a developed view of the second antenna element 400 according to an embodiment of the invention. Please refer to FIG. 1 and FIG. 4 together. The second antenna element 400 can be bent by 90 degrees with respect to a third bending line LB3 and a fourth bending line LB4. The third bending line LB3 may be positioned between the fourth surface E4 and the fifth surface E5 of the second nonconductive support element 130. The fourth bending line LB4 may be positioned between the fifth surface E5 and the sixth surface E6 of the second nonconductive support element 130. In the embodiment of FIG. 4, the second antenna element 400 includes a second feeding element 410, a fourth radiation element 420, a fifth radiation element 430, and a sixth radiation element 440.

The second feeding element 410 is positioned between the fifth radiation element 430 and the sixth radiation element 440, and is completely separate from the fifth radiation element 430 and the sixth radiation element 440. The second feeding element 410 has a first end 411 and a second end 412. The first end 411 of the second feeding element 410 is coupled to the second signal source 192. The fourth radiation element 420 may have a meandering shape, such as an inverted U-shape. One end of the fourth radiation element 420 is coupled to the second end 412 of the second feeding element 410. The fourth radiation element 420 further includes a terminal bifurcation structure 424 (at its other end). Specifically, the terminal bifurcation structure 424 includes a first rectangular widening portion 425 (with larger area) and a second rectangular widening portion 426 (with smaller area). A monopole slot 428 is formed between the first rectangular widening portion 425 and the second rectangular widening portion 426. In addition, the fourth radiation element 420 may further include a variable-width stepping structure 429 (at its middle) for fine-tuning the low-frequency impedance matching of the second antenna element 400. In some embodiments, the second feeding element 410 extends from the fourth surface E4 onto the fifth surface E5 of the second nonconductive support element 130, and the fourth radiation element 420 extends from the fifth surface E5 onto the sixth surface E6 of the second nonconductive support element 130.

The fifth radiation element 430 may substantially have an N-shape. The fifth radiation element 430 has a first end 431 and a second end 432. The first end 431 of the fifth radiation element 430 is coupled to the ground voltage VSS. The second end 432 of the fifth radiation element 430 is an open end, which is adjacent to the first rectangular widening portion 425 of the fourth radiation element 420. A third coupling gap GC3 is formed between the first rectangular widening portion 425 of the fourth radiation element 420 and the second end 432 of the fifth radiation element 430. The sixth radiation element 440 may substantially have an inverted J-shape. The sixth radiation element 440 has a first end 441 and a second end 442. The first end 441 of the sixth radiation element 440 is coupled to the ground voltage VSS. The second end 442 of the sixth radiation element 440 is an open end, which extends away from the fourth radiation element 420. In some embodiments, both the fifth radiation element 430 and the sixth radiation element 440 extend from the fourth surface E4 onto the fifth surface E5 of the second nonconductive support element 130.

Figure 5:
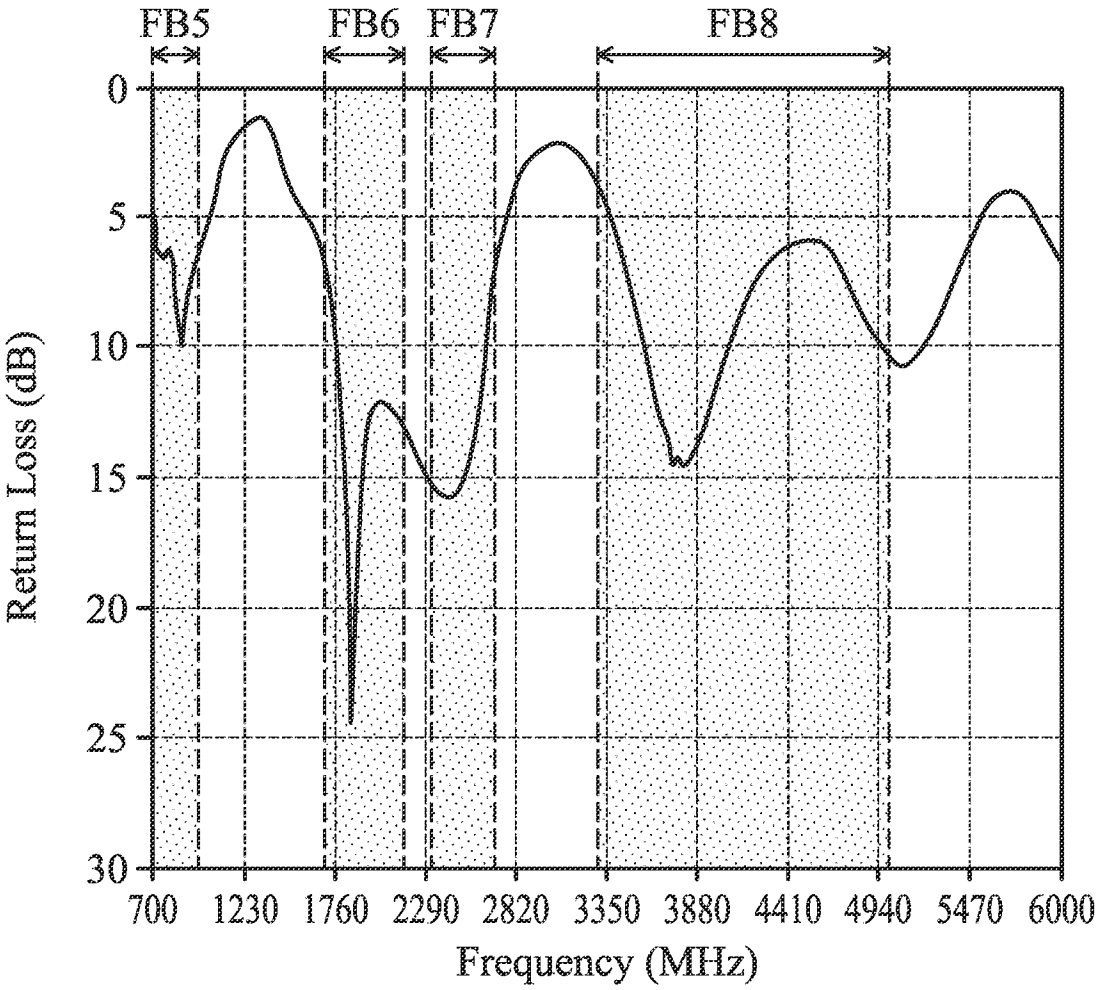
FIG. 5 is a diagram of return loss of a second antenna element according to an embodiment of the invention.

FIG. 5 is a diagram of return loss of the second antenna element 400 according to an embodiment of the invention. The horizontal axis represents the operation frequency (MHz), and the vertical axis represents the return loss (dB). According to the measurement of FIG. 5, the second antenna element 400 can cover a first frequency interval FB5, a second frequency interval FB6, a third frequency interval FB7, and a fourth frequency interval FB8. For example, the first frequency interval FB5 may be from 700 MHz to 960 MHz, the second frequency interval FB6 may be from 1710 MHz to 2170 MHz, the third frequency interval FB7 may be from 2300 MHz to 2690 MHz, and the fourth frequency interval FB8 may be from 3300 MHz to 5000 MHz. Accordingly, the second antenna element 400 can support at least the wideband operations of LTE and 5G.

As to the antenna theory, the second feeding element 410 and the fourth radiation element 420 are excited to generate the first frequency interval FB5 and the second frequency interval FB6. The fifth radiation element 430 is excited by the second feeding element 410 and the fourth radiation element 420 using a coupling mechanism, so as to generate the third frequency interval FB7. The sixth radiation element 440 is excited by the second feeding element 410 and the fourth radiation element 420 using a coupling mechanism, so as to generate the fourth frequency interval FB8.

In some embodiments, the element sizes of the second antenna element 400 are described as follows. The total length L5 of the second feeding element 410 and the fourth radiation element 420 may be shorter than or equal to 0.5 wavelength ($\lambda/2$) of the first frequency interval FB5. The length L6 of the fifth radiation element 430 may be from 0.25 to 0.5 wavelength ($\lambda/4$~$\lambda/2$) of the third frequency interval FB7. The length L7 of the sixth radiation element 440 may be from 0.25 to 0.5 wavelength ($\lambda/4$~$\lambda/2$) of the fourth frequency interval FB8. In the terminal bifurcation structure 424, the width of the first rectangular widening portion 425 is defined as a first width W3, and the width of the second rectangular widening portion 426 is defined as a second width W4. The ration (W4/W3) of the second width W4 to the first width W3 may be from ⅕ to ½, such as about ⅓. The distance D5 between the fifth radiation element 430 and the second feeding element 410 may be from 1 mm to 2 mm. The distance D6 between the sixth radiation element 440 and the second feeding element 410 may be from 1 mm to 2 mm. The width of the third coupling gap GC3 may be from 1 mm to 4 mm. The height H2 of the second nonconductive support element 130 may be from 7 mm to 11 mm. In addition, the distance DL between the first nonconductive support element 120 and the second nonconductive support element 130 may be from 30 mm to 40 mm. The above ranges of element sizes are calculated and obtained according to many experiment results, and they help to optimize the operation bandwidth and impedance matching of the second antenna element 400.

Figure 6:
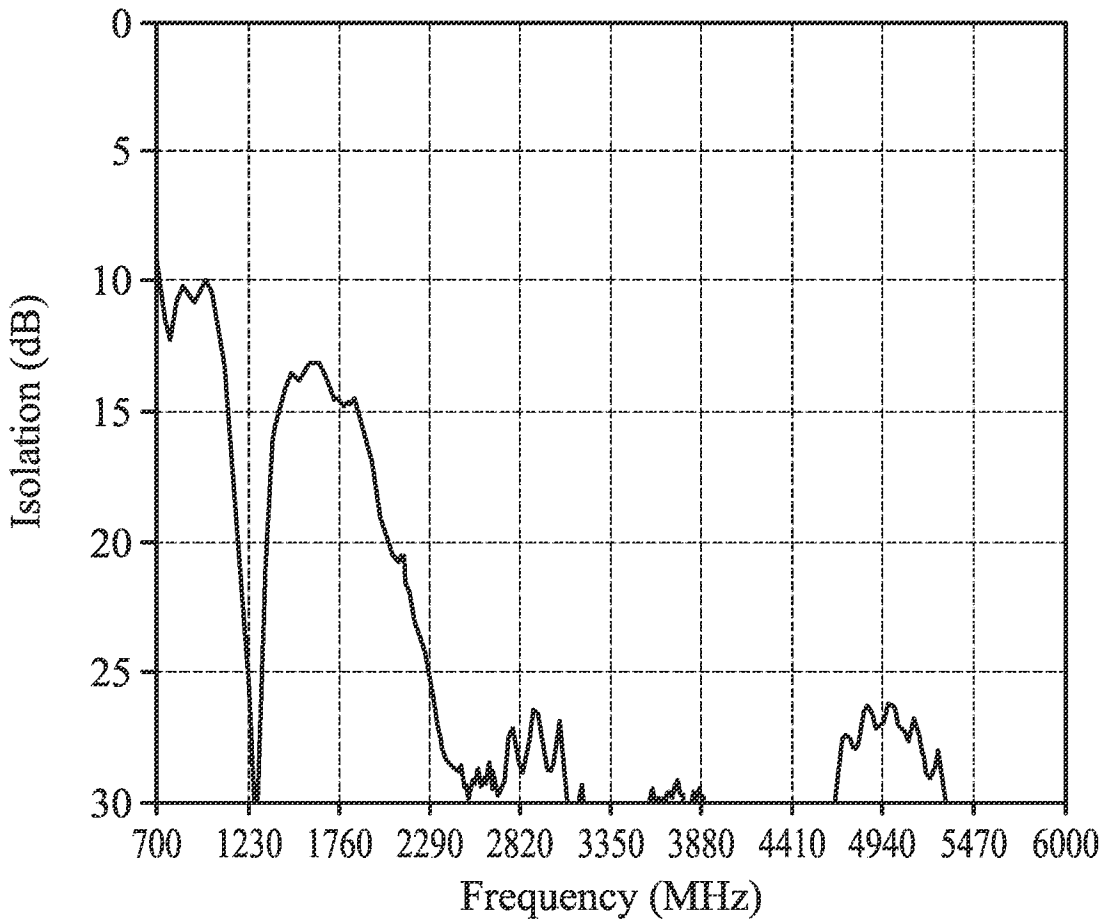
FIG. 6 is a diagram of isolation between a first antenna element and a second antenna element according to an embodiment of the invention.

FIG. 6 is a diagram of isolation between the first antenna element 200 and the second antenna element 400 according to an embodiment of the invention. The horizontal axis represents the operation frequency (MHz), and the vertical axis represents the isolation (dB) between the first antenna element 200 and the second antenna element 400. According to the measurement of FIG. 6, within the aforementioned wide operation frequency band, the isolation between the first antenna element 200 and the second antenna element 400 can be higher than 10 dB, and the corresponding ECC (Envelope Correlation Coefficient) can be lower than 0.2. It can meet the requirements of practical applications of general antenna systems with multiple antennas.

The invention proposes a novel antenna system. In comparison to the conventional design, the invention has at least the advantages of small size, wide bandwidth, multiple polarizations, high isolation, and low ECC, and therefore it is suitable for application in a variety of communication devices or automotive electronic devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-6. The invention may merely include any one or more features of any one or more embodiments of FIGS. 1-6. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a ground plane;

a first nonconductive support element, disposed adjacent to the ground plane;

a first antenna element, distributed over the first nonconductive support element, wherein the first antenna element is excited by a first signal source;

a second nonconductive support element, disposed adjacent to the ground plane; and a second antenna element, distributed over the second nonconductive support element, wherein the second antenna element is excited by a second signal source;

wherein both the first antenna element and the second antenna element cover a wide operation frequency band of LTE/5G;

wherein the first antenna element comprises:

a first feeding element, coupled to the first signal source;

a first radiation element, coupled to the first feeding element, wherein the first radiation element has a notch region;

a second radiation element, coupled to the ground plane, and disposed adjacent to the first radiation element and a third radiation element, coupled to the ground plane, and disposed adjacent to the first radiation element wherein the first feeding element is positioned between the second radiation element and the third radiation element wherein both of the second radiation element and the third radiation element are separate from the first radiation element.

2. The antenna system as claimed in claim 1, wherein the wide operation frequency band comprises a first frequency interval, a second frequency interval, a third frequency interval, and a fourth frequency interval, the first frequency interval is from 700 MHz to 960 MHz, the second frequency interval is from 1710 MHz to 2170 MHz, the third frequency interval is from 2300 MHz to 2690 MHz, and the fourth frequency interval is from 3300 MHz to 5000 MHz.

3. The antenna structure as claimed in claim 2, wherein a length of the first radiation element is shorter than or equal to 0.5 wavelength of the first frequency interval, a length of the second radiation element is from 0.25 to 0.5 wavelength of the third frequency interval, and a length of the third radiation element is from 0.25 to 0.5 wavelength of the fourth frequency interval.

4. The antenna system as claimed in claim 2, wherein the second antenna element comprises:

a second feeding element, coupled to the second signal source;

a fourth radiation element, coupled to the second feeding element, wherein the fourth radiation element comprises a terminal bifurcation structure;

a fifth radiation element, coupled to the ground plane, and disposed adjacent to the fourth radiation element; and a sixth radiation element, coupled to the ground plane;

wherein the second feeding element is positioned between the fifth radiation element and the sixth radiation element.

5. The antenna system as claimed in claim 4, wherein the terminal bifurcation structure of the fourth radiation element comprises a first rectangular widening portion and a second rectangular widening portion, and a monopole slot is formed between the first rectangular widening portion and the second rectangular widening portion.

6. The antenna system as claimed in claim 4, wherein the fifth radiation element substantially has an N-shape, and the sixth radiation element substantially has an inverted J-shape.

7. The antenna system as claimed in claim 4, wherein a total length of the second feeding element and the fourth radiation element is shorter than or equal to 0.5 wavelength of the first frequency interval, a length of the fifth radiation element is from 0.25 to 0.5 wavelength of the third frequency interval, and a length of the sixth radiation element is from 0.25 to 0.5 wavelength of the fourth frequency interval.

8. The antenna structure as claimed in claim 1, wherein the first radiation element substantially has a rectangular shape, and the notch region substantially has a square shape.

9. The antenna structure as claimed in claim 1. wherein the second radiation element substantially has a long straight-line shape, and the third radiation element substantially has a short straight-line shape.

* * * * *